US005239842A

United States Patent [19]

Gesensway

[11] Patent Number: 5,239,842

[45] Date of Patent: Aug. 31, 1993

[54] SPRING RING ADJUSTER

[76] Inventor: Sheldon Gesensway, 555 NE. 15th St., Gallery 10, Miami, Fla. 33132

[21] Appl. No.: 984,485

[22] Filed: Dec. 2, 1992

[51] Int. Cl.[5] ..... A44C 9/02

[52] U.S. Cl. ..... 63/15.6

[58] Field of Search ..... 63/15-15.8

[56] References Cited

U.S. PATENT DOCUMENTS

| | | | |
|---|---|---|---|
| 1,864,447 | 6/1932 | Lev | 63/15.6 |
| 2,770,112 | 11/1956 | Butts | 63/15.6 |
| 3,238,741 | 3/1966 | Johnson | 63/15.6 |
| 3,362,189 | 1/1968 | De Santo | 63/15.6 |
| 4,903,507 | 2/1990 | Gesensway | 63/15.6 |

*Primary Examiner*—Peter M. Cuomo

*Assistant Examiner*—Flemming Saether

*Attorney, Agent, or Firm*—Norman B. Rainer

[57] ABSTRACT

An attachment device for a finger ring for improving the fit of the ring is constructed from a clamp, an elongated spring secured by the clamp, and a resilient sleeve disposed upon the spring. The clamp is of monolithic construction, fabricated from a piece of thin sheet stock of a malleable metal and having a base portion elongated between two extremities and adapted to be bent so as to lie against the interior surface of the ring. At least two gripping portions extend from the extremities of the base portion. A bracket portion, which secures the spring, extends from one extremity of the base portion in a direction opposite to the gripping portions.

6 Claims, 1 Drawing Sheet

SPRING RING ADJUSTER

BACKGROUND OF THE INVENTION

1. Field of the Invention

This invention relates to finger rings of the type worn as items of ornamental jewelry, and more particularly concerns an improvement in the manner in which such rings fit upon the wearer's finger.

2. Description of the Prior Art

The aspect of the anatomy of a finger which is involved in the wearing of finger rings comprises the first and second phalanx bones, ligaments, tendons, flesh and the articular surfaces of these bones. Rings are normally worn encircling the shaft of the first phalanx. The proximal end of the second phalanx and the distal end of the first phalanx comprise the bone structure of the knuckle. The ends of the phalanges are enlarged to form the articular surfaces and constitute the prominence of the knuckle. The dorsal side of the first phalanx is convex and is tightly covered by skin with little compressive yield. The palmar side of the first phalanx has a yielding fleshy pad and flexion tendons more loosely covered by the skin. Thus, the portion of the finger where a ring is usually worn is an unyielding convex surface on the dorsal side and a fleshy pad on the palmar side. The greatest transverse dimension of the finger is the unyielding lateral or width dimensions of the knuckle of the first and second phalanges. This dimension is greater than the dimensions of the shaft of the first phalanx and the flesh encircled by a ring.

Nearly all finger rings employ a circular or substantially circular finger aperture having an interior diameter dictated by the size of the wearer's finger first joint knuckle. The ring must be large enough in diameter to slip past the knuckle. Since the interior diameter is larger than the width or depth of the shaft of the first row phalanx bones and flesh of the finger where rings are normally worn, the ring fits the finger loosely, thereby allowing the ring to turn easily.

Turning of rings about the finger is annoying since the gem or artwork carried by the finger fails to remain centered on the dorsal surface of the finger as is normally desired. The gem or artwork may rub against or injure adjacent fingers and may turn to appear on the palmar side of the hand where it may interfere with the wearer's grip, be damaged or cause damage to other objects.

The inherent looseness of circular finger rings may result in accidental loss by slipping over the wearer's knuckle during rapid hand movement or when the skin of the wearer's hand is cold, wet or lubricated with materials such as oil or soap. Valuable rings have been stolen from the hand of the wearer.

Among the various expedients earlier proposed for preventing the turning of a ring upon the finger, there has been disclosed non-circular ring shapes, rings comprised of interactive moving parts and attachment devices. Non-circular ring shapes are expensive to fabricate, and present certain inventory problems for the jeweler who must stock many different styles and sizes of rings. The presence of moving parts on the ring or on an attachment therefor presents the opportunity for eventual malfunction.

Attachment devices are often difficult to install onto a ring and generally require customized fitting by the jeweler. When so fitted, the wearer can wear the ring on just one finger. Certain attachment devices, although effective in preventing turning of the ring, cause certain discomforts to the wearer. It is also well known that a person's finger diameter changes periodically in view of minor fluctuations in skin moisture and temperature. Therefore, a ring which fits perfectly on one day may not fit properly on another day. Adjustment of earlier devices is generally achieved by the bending of a metal band disposed within the ring as a chord of a circle represented by the ring. Such adjustment often requires specialized tools for producing a V-shaped bend directed toward the finger for a tighter fit.

U.S. Pat. No. 4,903,507 to Gesensway discloses an attachment for a finger ring for enhancing fitting and wearing characteristics, said attachment employing a replaceable rubber band. Although effective for its intended purpose, the occasional need to replace the rubber bands may be considered an inconvenience. The rubber band also detracts from the appearance of the ring.

It is accordingly an object of the present invention to provide an attachment device for a substantially circular finger ring which will prevent inadvertent turning of the ring upon the wearer's finger.

It is another object of the present invention to provide an attachment device as in the foregoing object which does not require customized fitting to the wearer's finger.

It is a further object of the present invention to provide an attachment device of the aforesaid nature which enables the wearer to wear the same ring on any finger.

It is a still further object of the invention to provide an adjustment device of the aforesaid nature which is self adjusting, thereby accommodating periodic changes in finger diameter.

An additional object of this invention is to provide an attachment device of the aforesaid nature which does not require periodic replacement of parts.

Yet other objects of this invention are to provide an attachment device of the aforesaid nature which can be easily installed upon a ring, can be adjusted without specialized tools, and which is amenable to low cost manufacture.

These and other beneficial objects and advantages will be apparent from the following description.

SUMMARY OF THE INVENTION

The above and other beneficial objects and advantages are accomplished in accordance with the present invention by an attachment device for a ring fabricated of a substantially circular shank having interior, exterior and side surfaces and defining a central region, said device comprising:

a) a clamp of monolithic construction fabricated from a piece of thin sheet stock of a malleable metal and having a base portion elongated between two extremities and adapted to be bent so as to lie against said interior surface in close conformity therewith, at least two gripping portions extending co-directionally and perpendicularly from said base portion adjacent the extremities thereof and adapted to be bent in the same directions so as to embrace the exterior surface of the ring, and a bracket portion extending perpendicularly from said base portion adjacent one extremity thereof and in a direction opposite to the direction of the gripping portions, b) an elongated spring having a proximal extremity pivotably secured by said bracket portion, and a free distal extremity, said spring extending coextensively with said base portion between said gripping portions and configured to exert force toward said central region, and c) a resilient sleeve disposed upon said spring.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
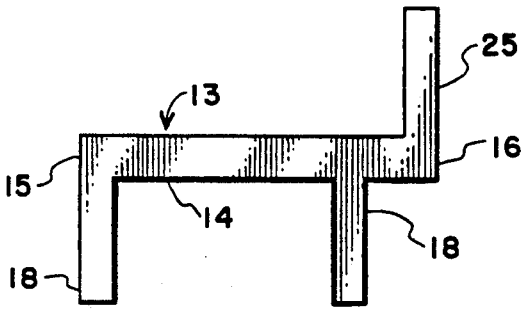
FIG. 1 is an enlarged plan view of a piece of sheet metal which serves as a precursor to the clamp component of the device of the present invention.
Figure 2:
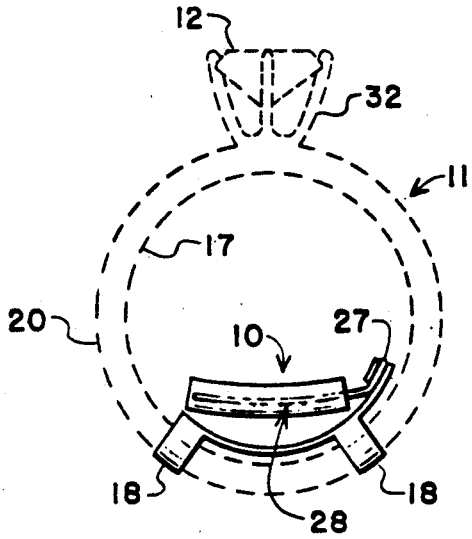
FIG. 2 is a side view of an embodiment of the device of this invention shown emplaced upon a ring.

Referring to FIGS. 1–4, an embodiment of the device 10 of this invention is shown mounted upon a jewelry ring 11 comprised of circular shank 31 having a mount 32 securing gem stone 12. Shank 31 is further characterized in having interior, exterior, and side surfaces 17, 20 and 33, respectively.

The device is comprised of a clamp 13 of monolithic construction, having been fabricated from a piece of thin sheet stock of a malleable, corrosion-resistant metal such as a silver alloy, aluminum, bronze, or the like. The clamp is fabricated from sheet stock by stamping or cutting, and bending operations. The clamp is comprised of a base portion 14 elongated between first and second extremities 15 and 16, respectively, and bent so as to lie against interior surface 17. Two gripping portions 18, which initially extend perpendicularly from the base portion adjacent extremities 15 and 16, are adapted to be bent in the same directions so as to traverse exterior surface 20. In some embodiments, gripping portions 18 may be of sufficient length so as to completely traverse exterior surface 20 and bend again onto interior surface 17. If the shank is extra wide, the gripping portions can be bent around side surface 33 and cemented to exterior surface 20. Gripping portion 18 is not bent onto interior surface 17 but is instead brought to the edge of 14, thereby keeping the thickness of the clamp to a minimum.

Figure 3:
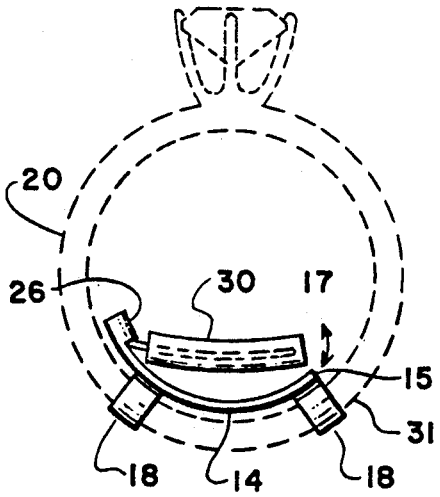
FIG. 3 is a view of the side opposite to that shown in FIG. 2.
Figure 4:
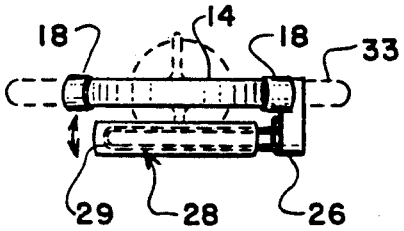
FIG. 4 is an end view taken from the bottom of FIG. 2.

A bracket portion 25 is orthogonally emergent from base portion 14 adjacent second extremity 16. The clamp can be fitted onto the ring using half round pliers to facilitate bending and seating of gripping portions 18. Bracket portion 25 is bent at its outermost extremity to form a U-shaped holding loop 26 which secures proximal extremity 27 of spring 28 in a manner permitting limited pivotal or wriggle movement of the spring in a direction shown by the double arrow of FIG. 4. Said spring may be a flat spring, coil spring, spring wire or flat flexible plastic strip. In the illustrated embodiment, a spring wire is employed which is bent and doubled back to the proximal extremity. The spring extends in a direction between extremities 15 and 16 and may lie either within the plane of the ring or in a closely adjacent parallel plane. The dual mode of motion of the spring, as shown by the double-headed arrows in FIGS. 3 and 4, is an important feature of the device. In a particularly preferred embodiment, the distal extremity of the spring extends beyond first extremity 15.

A resilient tubular plastic sleeve 30 is disposed upon the spring. The plastic sleeve 30 is disposed upon about 70% to 80% of the spring length measured from the distal extremity toward the proximal extremity. If the sleeve extended to loop 26, it would contact base portion 14, and the sleeve would be pushed forward, thereby pushing it away from the ring and causing the ring to be pushed off the finger. The plastic sleeve may suitable be a length of plasticized polyvinylchloride tubing having an interior diameter causing the tubing to frictionally secure the spring. The sleeve may be further secured onto the spring by bonding agents or by a hot squeezing operation which achieves permanent flattening of the tube onto the spring.

In use, the wearer inserts his finger through the ring having the device of this invention attached. During such insertion, the spring exerts a sideward force by virtue of a second mode of motion, namely a wriggling movement pivotably centered at loop 26, causing the spring to move in a direction othogonal to the ring, as shown by the double arrows of FIG. 4. Once on the finger, the spring is upwardly urged toward the finger, representing a first mode of motion, as shown by the double arrow in FIG. 3. If there were no sideward and upward force, sleeve 30 would not hold its position beside or under the shank if the ring is moved forward. When the ring is removed from the finger, the braking action of sleeve 30 is noticiable.

For best results, the ring should be 1¼ of a size larger than the knuckle, and up to three sizes larger than the finger. The center of base portion 14 can be secured upon the inside of the ring shank with half round pliers. With fingers, gripping portions 18 can be twisted around the shank. Any adjustment required in the position of the spring can be achieved by bending the spring sharply adjacent its proximal extremity so as to dispose the distal extremity closer to the center of the ring. Such bending can be done by finger manipulation. When properly adjusted, the device provides good fitting characteristics without discomfort to the wearer.

The usefulness of the device of this invention is based on the endurance and effectiveness of the spring and its manner of function. A great deal of stress is placed on a thin spring when the device is placed on or removed from a finger. To find a method that would allow a thin spring to retain its integrity over a long period of use was the technical difficulty that was overcome. In tests, a ring having the device of this invention was applied to and removed from a finger over 2000 times.

Clamp 13 can be trimmed at the edges darkly shaded in FIG. 1 to fit the widths of all shanks and still function properly.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An attachment device for a ring of substantially circular contour having a central region and interior and exterior surfaces, said device comprising:

a) a clamp of monolithic construction fabricated from a piece of thin sheet stock of a malleable metal and having a base portion elongated between first and second extremities and adapted to be bent so as to lie against said interior surface in close conformity therewith, at least two gripping portions extending codirectionally and perpendicularly from said base portion adjacent the extremities thereof and adapted to be bent so as to embrace the exterior surface of the ring, and a bracket portion extending perpendicularly from said base portion adjacent said second extremity and in a direction opposite to the direction of the gripping portions, b) an elongated spring having a proximal extremity secured to said bracket portion, and a free distal extremity, said spring extending coextensively with said base portion and configured to exert force in a first mode of motion toward said central region, and c) a resilient sleeve disposed upon said spring.

2. The device of claim 1 wherein said sleeve is disposed upon only a portion of said spring, said portion extending between 70% and 80% of the distance going from said distal extremity toward said proximal extremity.

3. The device of claim 1 wherein said spring is a wire in loop form.

4. The device of claim 1 wherein said distal extremity extends beyond the first extremity of said base portion.

5. The device of claim 1 wherein the spring has some pivotal movement in its securement to said bracket portion, permitting limited movement of the spring in a second mode of motion orthogonal to the plane of the ring.

6. The device of claim 1 wherein said gripping portions are codirectionally disposed from the same side of said base portion and are adapted to be bent in the same directions to embrace the shank of the ring.

* * * * *